US008265507B2

(12) United States Patent
Saito et al.

(10) Patent No.: US 8,265,507 B2
(45) Date of Patent: Sep. 11, 2012

(54) HEAT FIXING APPARATUS

(75) Inventors: Tohru Saito, Mishima (JP); Shinji Hashiguchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/342,314

(22) Filed: Jan. 3, 2012

(65) Prior Publication Data

US 2012/0099910 A1 Apr. 26, 2012

Related U.S. Application Data

(63) Continuation of application No. 12/472,909, filed on May 27, 2009, now Pat. No. 8,112,024.

(30) Foreign Application Priority Data

May 30, 2008 (JP) ..... 2008-142835
Dec. 17, 2008 (JP) ..... 2008-320916
May 14, 2009 (JP) ..... 2009-117593

(51) Int. Cl.
*G03G 15/20* (2006.01)

(52) U.S. Cl. ..... 399/69; 399/329; 399/334; 219/216

(58) Field of Classification Search ..... 399/69, 399/329, 334
See application file for complete search history.

(56) References Cited

U.S. PATENT DOCUMENTS 6,469,279 B1 * 10/2002 Ohtsuka ..... 219/216
7,177,579 B2 2/2007 Uchida et al.
7,190,914 B2 3/2007 Nihonyanagi et al.
7,193,181 B2 3/2007 Makihira et al.
7,215,899 B2 5/2007 Kimizuka et al.
7,251,447 B2 7/2007 Kanamori et al.
7,280,775 B2 10/2007 Kubochi et al.
7,283,763 B2 10/2007 Akizuki et al.
7,518,089 B2 4/2009 Hashiguchi et al.
2007/0025750 A1 2/2007 Ando
2009/0304421 A1 12/2009 Saito et al.
2010/0074661 A1 3/2010 Hashiguchi

FOREIGN PATENT DOCUMENTS

JP 63-313182 A 12/1988
JP 2-157878 A 6/1990
JP 4-44075 A 2/1992
JP 4-44076 A 2/1992
JP 4-44077 A 2/1992
JP 4-44078 A 2/1992
JP 4-44079 A 2/1992
JP 4-44080 A 2/1992
JP 4-44081 A 2/1992

(Continued)

*Primary Examiner* — Walter L Lindsay, Jr.
*Assistant Examiner* — Benjamin Schmitt
(74) *Attorney, Agent, or Firm* — Fitzpatrick, Cella, Harper & Scinto

(57) ABSTRACT

The heat fixing apparatus includes a fixing heater and a pressure roller. The fixing heater has a plurality of resistance-type heat generation layers which are different in heat distribution in the longitudinal direction perpendicular to the direction of conveying a recording material. The recording material P is heated when passed through a fixing nip portion formed between the fixing heater and the pressure roller. The pressurization conditions between the fixing heater and the pressure roller can be changed. The heat fixing apparatus includes a fixing member which adjusts the lengthwise heat distribution of the fixing heater by changing the applied current proportion of the plurality of resistance-type heat generation layers according to the pressurization conditions between the fixing heater and the pressure roller.

16 Claims, 9 Drawing Sheets

| | SHEET WIDTH (mm) | | | | | | | | | |
|---|---|---|---|---|---|---|---|---|---|---|
| | ≥300.1 | | 290.0-300.0 | | 268.0-289.9 | | 234.0-267.9 | | ≤233.9 | |
| | MAIN | SUB | MAIN | SUB | MAIN | SUB | MAIN | SUB | MAIN | SUB |
| UNDER FIRST PRESSURIZATION CONDITION | 50.00% | 100.00% | 100.00% | 100.00% | 100.00% | 65.00% | 100.00% | 65.00% | 100.00% | 65.00% |
| UNDER SECOND PRESSURIZATION CONDITION | 100.00% | 0% | 100.00% | 0% | 100.00% | 0% | 100.00% | 0% | 100.00% | 0% |

FOREIGN PATENT DOCUMENTS

| | | | |
|---|---|---|---|
| JP | 4-44082 | A | 2/1992 |
| JP | 4-44083 | A | 2/1992 |
| JP | 4-204980 | A | 7/1992 |
| JP | 4-204981 | A | 7/1992 |
| JP | 4-204982 | A | 7/1992 |
| JP | 4-204983 | A | 7/1992 |
| JP | 4-204984 | A | 7/1992 |
| JP | 2004-251927 | A | 9/2004 |
| JP | 2006-184488 | A | 7/2006 |
| JP | 2007-128037 | A | 5/2007 |

* cited by examiner

FIG. 9A
NIP SHAPE UNDER FIRST PRESSURIZATION CONDITION
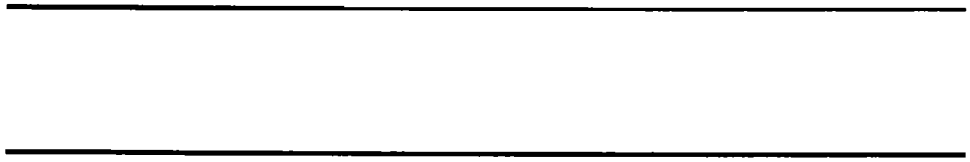
FIG. 9B
NIP SHAPE UNDER SECOND PRESSURIZATION CONDITION
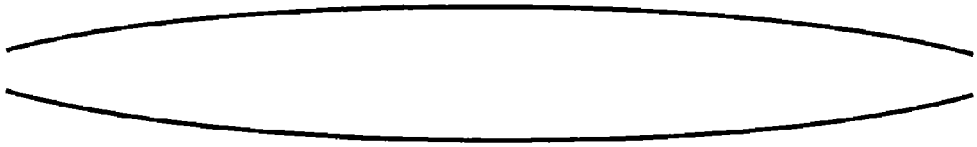
FIG. 10
| | | FIXING NIP WIDTH |
|---|---|---|
| PRESSURIZATION CONDITION | CENTER | THERMISTOR POSITION AT EDGE PORTION THERMISTOR (ABOUT 144mm FROM CENTER) |
| UNDER FIRST PRESSURIZATION CONDITION | 8.5mm | 9.0mm |
| UNDER SECOND PRESSURIZATION CONDITION | 8.0mm | 6.0mm |

FIG. 11

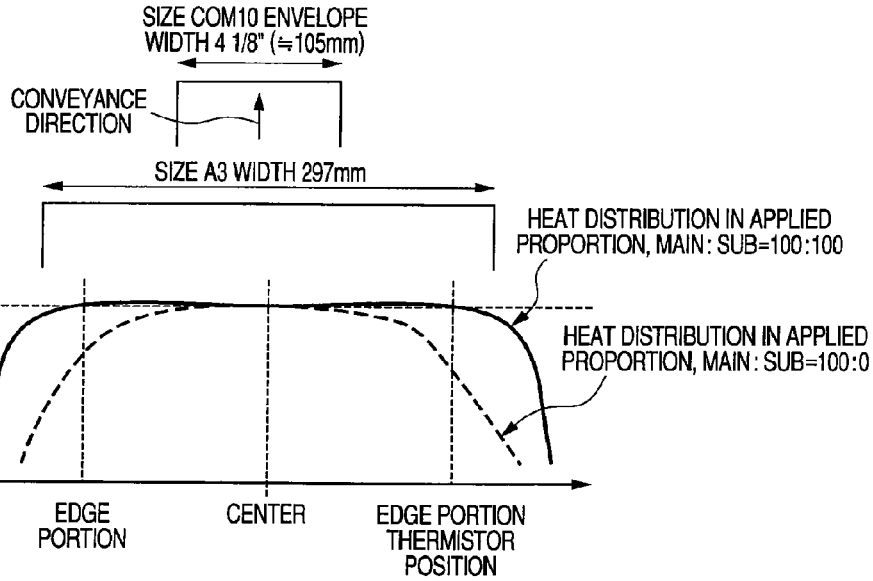

FIG. 12

| PRESSURIZATION CONDITION | APPLIED CURRENT PROPORTION | RISING TEMPERATURE OF CENTER THERMISTOR PORTION DURING SHEET PASSES | RISING TEMPERATURE OF EDGE PORTION THERMISTOR DURING SHEET PASSES | |
|---|---|---|---|---|
| UNDER FIRST PRESSURIZATION CONDITION | MAIN : SUB= 100 : 100 | ABOUT 250℃ | ABOUT 245℃ | |
| UNDER SECOND PRESSURIZATION CONDITION | MAIN : SUB= 100 : 100 | ABOUT 250℃ | ABOUT 270-280℃ | (COMPARISON EXAMPLE) |
| UNDER SECOND PRESSURIZATION CONDITION | MAIN : SUB= 100 : 0 | ABOUT 250℃ | ABOUT 200℃ | (THIS EMBODIMENT) |

| | SHEET WIDTH (mm) | | | | | | | | | |
|---|---|---|---|---|---|---|---|---|---|---|
| | ≥300.1 | | 290.0–300.0 | | 268.0–289.9 | | 234.0–267.9 | | ≤233.9 | |
| | MAIN | SUB | MAIN | SUB | MAIN | SUB | MAIN | SUB | MAIN | SUB |
| UNDER FIRST PRESSURIZATION CONDITION | 50.00% | 100.00% | 100.00% | 100.00% | 100.00% | 65.00% | 100.00% | 65.00% | 100.00% | 65.00% |
| UNDER SECOND PRESSURIZATION CONDITION | 100.00% | 0% | 100.00% | 0% | 100.00% | 0% | 100.00% | 0% | 100.00% | 0% |

HEAT FIXING APPARATUS

This application is a continuation of U.S. patent application Ser. No. 12/472,909, filed May 27, 2009, pending.

BACKGROUND OF THE INVENTION

1. Field of the Invention

The present invention relates to a heat fixing apparatus, and more particularly, to a heat fixing apparatus in an image forming apparatus using an imaging process such as an electrophotographic process and an electrostatic recording process. Further, more specifically, the present invention relates to an image forming apparatus having a heat fixing apparatus which performs a heat fixing process on an unfixed toner image of target image information formed and carried on a recording material, as a fixed image, in a transfer process or a direct process by the imaging process portion. Here, the examples of the recording material include a transfer material, a print paper, a photosensitive paper, and an electrostatic recording paper.

2. Description of the Related Art

An apparatus using an endless belt (endless film) has been in practical use as a heat fixing apparatus. A typical example is illustrated in FIG. 13. More specifically, in FIG. 13, a film assembly 60 includes a heating heater 61, a stay holder 62, and a thin film (fixing film) 63. The heating heater 61 has a heat generation resistance layer generating heat by electrification, the heat generation resistance layer being formed on a ceramic substrate made of alumina, aluminum nitride or the like. The heating heater 61 is fixed to the stay holder 62 made of heat-resistant resin. The heat-resistant thin film (hereinafter referred to as fixing film) 63 is made of a resin such as a polyimide or a metal such as Stainless Used Steel (SUS) and is loosely fit on the stay holder 62. The fixing film 63 is pressure-sandwiched between the heating heater 61 of the film assembly 60 and an elastic pressure roller 50 to form a fixing nip portion.

The elastic pressure roller 50 includes a metal core 51, an elastic layer 52 made of silicon rubber or the like and provided on the outer surface of the metal core 51, and a mold release layer 53 made of a fluorocarbon resin or the like. The fixing film 63 is transported and moved in a direction of the arrow sliding in close contact with the heating heater 61 at the fixing nip portion by a rotational drive force of the elastic pressure roller 50 in the direction of the arrow. The temperature of the heating heater 61 is detected by a temperature detection unit 64 such as a thermistor provided on the rear surface of the heater, is fed back to a power control portion (not shown), and the heating heater 61 is adjusted to be at a predetermined constant temperature (fixing temperature). Various image forming apparatuses as a printer and a copy machine having such a heat fixing apparatus using a film heating process have a lot of advantages in comparison with a conventional heat fixing apparatus using a heat roller process. The examples of the advantages include a high heating efficiency and a quick activation, which can eliminate the necessity of preheating during a wait time and can reduce the wait time.

Recently, various types of print media (recording material) have been used for copy machines and printers. In order to handle such a diversity of media types, the heat fixing apparatus also needs to adjust the fixing conditions for the specific medium.

As one of the means for changing the fixing conditions, there has been a method of changing the pressure applied to the fixing nip portion. For example, the Japanese Patent Application Laid-Open No. 2007-128037 discloses a measure by which when an envelope is printed, the pressure applied to the fixing nip portion is made lower than when a regular paper is printed to prevent the envelope from been deflected.

However, when the recording material is exposed to a reduced pressurization condition (second pressurization condition), the following problems occur.

More specifically, when pressure is applied to a pressurization member and a heating member at both lengthwise edge portions perpendicular to the conveyance direction of the recording material, the pressurization member and the heating member are deflected. The greater the applied pressure, the greater the deflection. When the pressurization member and the heating member suffer a large amount of deflection due to their light weight and use of low cost materials, at least one of the pressurization member and the heating member needs to be formed in a crown shape (the center portion is larger than the edge portions) allowing for the amount of deflection. This allows an optimal nip shape to be set under the normal pressurization condition (first pressurization condition).

For this reason, when the pressure is applied to the fixing nip portion as the second pressurization condition in order to prevent the envelope from being deflected, the amount of deflection is reduced accordingly. However, the width of the fixing nip portion becomes uneven in the longitudinal direction. More specifically, the width of the fixing nip portion in the edge portions becomes smaller than that in the center portion.

Therefore, when a sheet is passed (fixing process) under the second pressurization with the same heat distribution (in applied current proportion of a respective heat generation member) of heat generation members as at the first pressurization, the heat of the heating member is difficult to be transmitted to the pressurization member in the edge portions because the width of the fixing nip portion in the edge portions is small (narrow). Therefore, the temperature of the heating member excessively rises, thereby causing a problem in that the durability of the fixing member is reduced.

Further, when the temperature of the fixing apparatus is raised with the pressure applied to the fixing nip portion corresponding to the second pressurization condition, the heat of the heating member is difficult to be transmitted to the pressurization member in the edge portions, thereby causing the same problem as the fixing process under a reduced pressurization condition.

SUMMARY OF THE INVENTION

In view of the above problems, the present invention has been made, and an object of the present invention is to provide a heat fixing apparatus capable of preventing the excessively rising temperature of the lengthwise edge portions when the fixing process is performed with the pressure applied to the fixing nip portion set to the second pressure.

Another object of the present invention is to provide a heat fixing apparatus capable of preventing the excessive temperature rise of the lengthwise edge portions when the temperature of the heater is raised to a fixable temperature with the pressure applied to the fixing nip portion set to the second pressure.

Another object of the present invention is to provide a heat fixing apparatus for heating and fixing a toner image formed on a recording material onto the recording material, comprising: an endless belt; a heater that contacts an internal surface of the endless belt, the heater having a first heat generation member, and a second heat generation member whose ratio of the resistance value per a unit length at edge portions of the heater and to the resistance value per the unit length at a center portion of the heater in a longitudinal direction is larger than the ratio of the resistance value per the unit length at edge portions of the heater and to the resistance value per the unit length at a center portion of the heater in a longitudinal direction of the first heat generation member; a back-up member for forming a fixing nip portion that pinches and conveys a recording material through the endless belt together with the heater; and a pressure change mechanism capable of setting the pressure applied to the fixing nip portion to a first pressure and a second pressure lower than the first pressure. The apparatus operates in a first fixing process mode for performing a fixing process under the first pressure and a second fixing process mode for performing a fixing process under the second pressure. When the fixing process is performed in the second fixing process mode, the heat proportion of the second heat generation member is set to be smaller than the heat proportion of the first heat generation member independently of the size of the recording material.

A further object of the present invention is to provide a heat fixing apparatus for heating and fixing a toner image formed on a recording material onto the recording material, comprising: an endless belt; a heater that contacts an internal surface of the endless belt, the heater having a first heat generation member, and a second heat generation member whose ratio of the resistance value per a unit length at edge portions of the heater and to the resistance value per the unit length at a center portion of the heater in a longitudinal direction is larger than the ratio of the resistance value per the unit length at edge portions of the heater and to the resistance value per the unit length at a center portion of the heater in a longitudinal direction of the first heat generation member; a back-up member for forming a fixing nip portion that pinches and conveys a recording material through the endless belt together with the heater; and a pressure change mechanism capable of setting the pressure applied to the fixing nip portion to a first pressure and a second pressure lower than the first pressure. When the temperature of the heater is raised to a fixable temperature with the pressure applied to the fixing nip portion set to the second pressure, the heat proportion of the second heat generation member is set to be smaller than the heat proportion of the first heat generation member.

A still further object of the present invention will be apparent by reading the following detailed description with reference to the accompanying drawings.

BRIEF DESCRIPTION OF THE DRAWINGS

FIG. 9A is a drawing illustrating a nip shape of a fixing nip portion under the first pressurization condition in accordance with the first and second embodiments.

FIG. 9B is a drawing illustrating a nip shape of a fixing nip portion under the second pressurization condition in accordance with the first and second embodiments.

FIG. 10 is a drawing illustrating a fixing nip width under the first pressurization condition and the second pressurization condition in accordance with the first and second embodiments.

FIG. 11 is a drawing showing the size of a recording material in accordance with the first embodiment and illustrating a heat distribution in applied current proportion of different heaters.

FIG. 12 is a table showing the pressurization condition, the applied current proportion of the heater, and the rising temperatures of the thermistor units in the center and edge portions during sheet passes respectively in accordance with the first embodiment.

DESCRIPTION OF THE EMBODIMENTS

Hereinafter, exemplary embodiments of the present invention will be illustratively described in detail with reference to the accompanying drawings. It should be noted that the sizes, the materials, the shapes, and their relative layouts of the respective components disclosed in the embodiments should be modified as needed depending on the configuration of the apparatus and other conditions to which the present invention is applied and thus the scope of the present invention should not be limited to the following embodiments.

First Embodiment (1) An Example of Image Forming Apparatus

Figure 1:
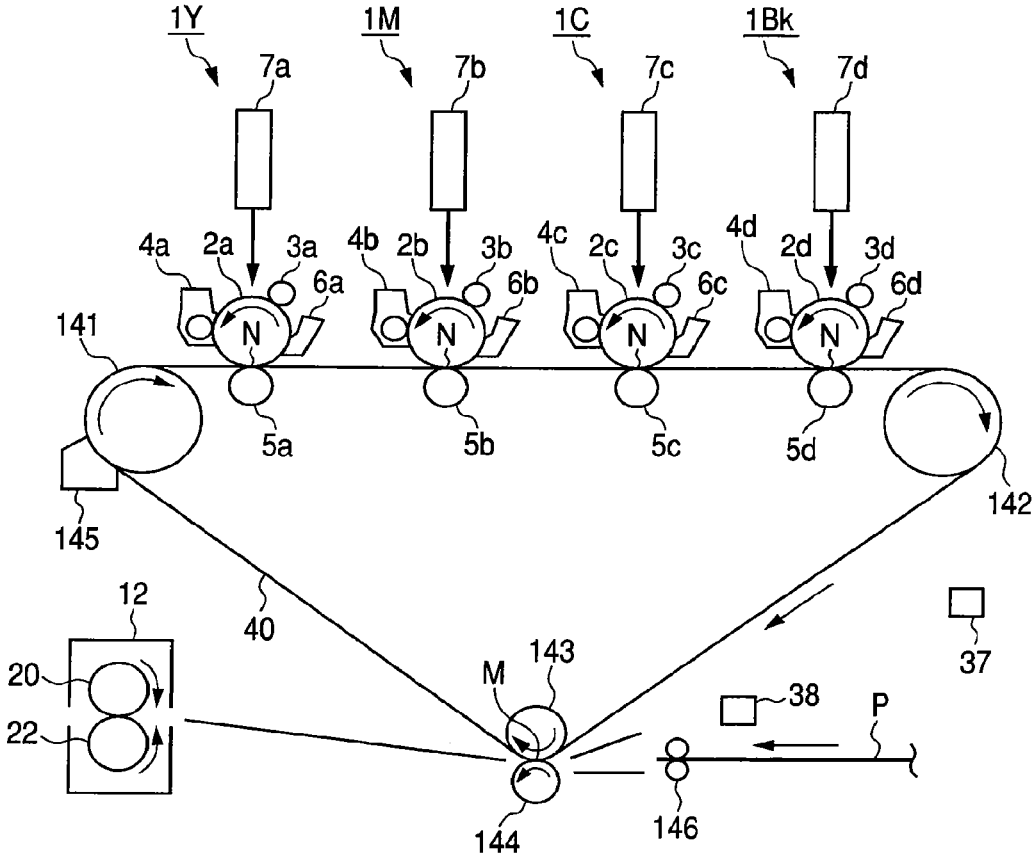
FIG. 1 is a schematic configuration view illustrating a color image forming apparatus in accordance with the first and second embodiments.

FIG. 1 is a schematic configuration view illustrating a color image forming apparatus in accordance with the present embodiment. The image forming apparatus in accordance with the present embodiment is a tandem full color printer using the electrophotographic process capable of passing a recording material up to A3 size.

The image forming apparatus includes four image forming units: an image forming unit 1Y forming a yellow image, an image forming unit 1M forming a magenta image, an image forming unit 1C forming a cyan image, and an image forming unit 1Bk forming a black image. The four image forming units are arranged on a line at a constant interval.

The respective image forming units 1Y, 1M, 1C, and 1Bk include electro-photosensitive drums 2*a*, 2*b*, 2*c*, and 2*d* respectively. Respective charge rollers 3*a*, 3*b*, 3*c*, and 3*d*, respective development apparatuses 4*a*, 4*b*, 4*c*, and 4*d*, respective transfer rollers 5*a*, 5*b*, 5*c*, and 5*d*, and respective drum cleaning apparatuses 6*a*, 6*b*, 6*c*, and 6*d* are arranged around the respective electro-photosensitive drums 2*a*, 2*b*, 2*c*, and 2*d* respectively. Respective exposure apparatuses 7*a*, 7*b*, 7*c*, and 7*d* are arranged above between the respective charge rollers 3*a*, 3*b*, 3*c*, and 3*d* and the respective development apparatuses 4*a*, 4*b*, 4*c*, and 4*d*. The respective development apparatuses 4*a*, 4*b*, 4*c*, and 4*d* store yellow toner, magenta toner, cyan toner, and black toner, respectively.

An endless belt shaped intermediate transfer belt 40 as a transfer medium abuts against the respective primary transfer nip portions N of the respective electro-photosensitive drums 2*a*, 2*b*, 2*c*, and 2*d* of the respective image forming units 1Y, 1M, 1C, and 1Bk. The intermediate transfer belt 40 is laid across in a tensioned state between a drive roller 141, a support roller 142, and a secondary transfer counter roller 143, and is rotated (moved) in the direction of the arrow (clockwise) by the drive of the drive roller 141.

The respective transfer rollers 5*a*, 5*b*, 5*c*, and 5*d* for primary transfer abut against the respective electro-photosensitive drums 2*a*, 2*b*, 2*c*, and 2*d* at the respective primary transfer nip portions N via the intermediate transfer belt 40.

The secondary transfer counter roller 143 abuts against a secondary transfer rollers 144 via the intermediate transfer belt 40 to form a secondary transfer nip portion M. The secondary transfer roller 144 is freely detachably attached to the intermediate transfer belt 40.

A belt cleaning apparatus 145 is provided in the vicinity of the drive roller 141 outside the intermediate transfer belt 40 so as to remove and recover transfer toner remaining on the surface of the intermediate transfer belt 40.

A fixing apparatus 12 (heat fixing apparatus) is provided at a downstream side in the conveyance direction of the recording material P (member to be heated) of the secondary transfer nip portion M. Note that the right-hand side in the figure indicates the upstream side in the conveyance direction, and left-hand side thereof indicates the downstream side in the conveyance direction.

Further, the image forming apparatus includes an environment sensor 37 and a media sensor 38.

According to the present embodiment, when an image forming operation start signal is issued, the respective electro-photosensitive drums 2*a*, 2*b*, 2*c*, and 2*d* of the respective image forming units 1Y, 1M, 1C, and 1Bk rotatably driven at a predetermined process speed are uniformly charged to the negative polarity by the respective charge rollers 3*a*, 3*b*, 3*c*, and 3*d* respectively.

Then, the respective exposure apparatuses 7*a*, 7*b*, 7*c*, and 7*d* convert a respective color-divided image signal input therein to a respective optical signal at laser output unit (not illustrated) respectively. Then, the converted optical signal, namely, a laser beam, scans and exposes the respective charged electro-photosensitive drums 2*a*, 2*b*, 2*c*, and 2*d* to form a respective electrostatic latent image respectively.

First, an electrostatic latent image is formed on the electro-photosensitive drum 2*a*. Then, a developing bias having the same polarity as the charged polarity (negative polarity) of the electro-photosensitive drum 2*a* is applied to the development apparatuses 4*a*. Then, the development apparatus 4*a* electrostatically attracts yellow toner onto the electro-photosensitive drum 2*a* according to the charged potential of the surface of the electro-photosensitive drum 2*a*. As a result, the latent image is visualized into a developed image. Here, a primary transfer bias (positive polarity opposite to the toner) is applied to the transfer roller 5*a* at the primary transfer nip portion N. Then, the transfer roller 5*a* transfers the yellow toner image onto the rotating intermediate transfer belt 40. The intermediate transfer belt 40 carrying the transferred yellow toner image is rotated toward the image forming unit 1M side.

Next, the image forming unit 1M operates in the same manner as the image forming unit 1Y. More specifically, a magenta toner image formed on the electro-photosensitive drum 2*b* is transferred onto the intermediate transfer belt 40 at the primary transfer nip portion N so as to be overlapped on the yellow toner image thereon.

Likewise, the cyan and black toner images formed on the respective electro-photosensitive drums 2*c* and 2*d* of the respective image forming units 1C and 1Bk are sequentially overlapped onto the yellow and magenta toner images superposedly transferred on the intermediate transfer belt 40 at the respective primary transfer nip portions N respectively. In this manner, a full color toner image is formed on the intermediate transfer belt 40.

Next, the front edge of the full color toner image on the intermediate transfer belt 40 is moved to the secondary transfer nip portion M. At this timing, a resist roller 146 conveys the recording material (transfer material) P to the secondary transfer nip portion M. Then, the secondary transfer roller 144, to which a secondary transfer bias (positive polarity opposite to the toner) is applied, collectively transfers the full color toner image onto the recording material P. The recording material P, on which the full color toner image is formed, is conveyed to the fixing member 12, where the full color toner image is heated and pressurized at a fixing nip portion between a fixing sleeve 20 and a pressure roller 22 (pressurization member) to be melt-fixed on the surface of the recording material P. Subsequently, the recording material P is discharged outside as an output image of the image forming apparatus. Then, the series of image forming operations are terminated.

It should be noted that the image forming apparatus includes an environment sensor 37 therein, and thus the charging, developing, primary transfer, and secondary transfer biases, and fixing conditions can be changed according to the atmospheric environment (temperature and humidity) inside the image forming apparatus. The detection results of the environment sensor 37 are used to adjust the density of the toner image formed on the recording material P and to achieve the optimal transfer and fixing conditions. Further, the image forming apparatus includes the media sensor 38 therein, which determines the recording material P. Therefore, the transfer biases and fixing conditions can be changed according to the recording material P, and the detection results by the media sensor 38 are used to achieve the optimal transfer and fixing conditions with respect to the recording material P.

At the time of the primary transfer described above, the primary transfer toner remaining on the electro-photosensitive drums 2*a*, 2*b*, 2*c*, and 2*d* is removed and recovered by the respective drum cleaning apparatuses 6*a*, 6*b*, 6*c*, and 6*d* respectively. At the time of the secondary transfer, the secondary transfer toner remaining on the intermediate transfer belt 40 is removed and recovered by the belt cleaning apparatus 145.

(2) Fixing Apparatus 12

Figure 2:
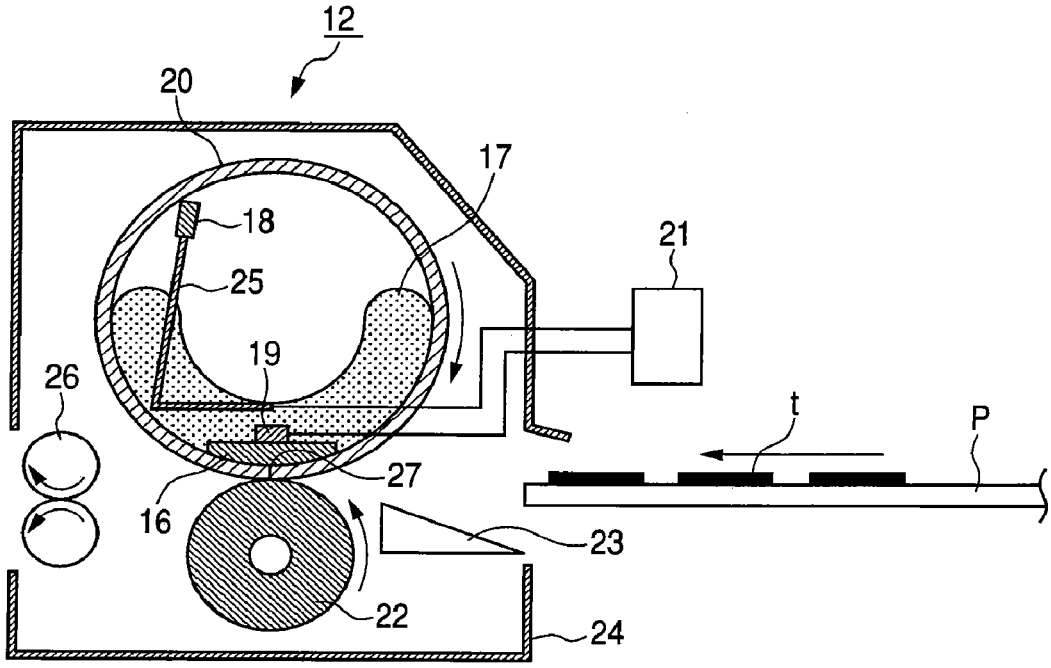
FIG. 2 is a schematic configuration view of a fixing member in accordance with the first and second embodiments.

FIG. 2 is a schematic configuration view of the fixing apparatus 12. The fixing apparatus 12 in accordance with the present embodiment is a heat fixing apparatus using a driving system with a rotary member for pressurization (tensionless type).

1) Entire Configuration of Fixing Apparatus 12

The fixing sleeve 20 is a cylindrical member (endless belt) having an elastic layer on a belt-shaped member. The fixing sleeve 20 is described in detail later at 3).

The pressure roller 22 is a back-up member. A heater holder 17 is heat-resistant and rigid with the cross-sectional shape of a substantially semicircular arch shaped trough. A fixing heater 16 is a heating member (heat source) and is provided on the lower surface of the heater holder 17 along the longitudinal direction of the heater holder 17 (in a direction perpendicular to the conveyance direction of the recording material). The fixing sleeve 20 is loosely fit up over to the heater holder 17. The fixing heater 16 is a ceramic heater as described in detail later at 2) according to the present embodiment.

The heater holder 17 is made of a highly heat-resistant liquid-crystal polymer resin and serves to hold the fixing heater 16 and guide the fixing sleeve 20. According to the present embodiment, as the liquid crystal polymer resin, Zenite 7755 (trade name) produced by DuPont is used. The maximum usable temperature of Zenite 7755 is approximately 270° C.

The pressure roller 22 is configured such that a silicon rubber layer with a thickness of approximately 3 mm is formed on a hollow metal core made of aluminum or iron (SUM material: Steel Use Machinability), and the silicon rubber layer is covered with a PFA resin tube with a thickness of approximately 40 μm. The pressure roller 22 is arranged such that both edge portions of the metal core are rotatably borne and held between the side plates (not illustrated) at the back side of an apparatus frame 24 and at the front side thereof. Above the pressure roller 22, there is provided a fixing sleeve unit including the fixing heater 16, the heater holder 17, the fixing sleeve 20, and the like. The fixing sleeve unit is arranged in parallel to the pressure roller 22 with the fixing heater 16 side downward. Then, a pressure mechanism (not illustrated) biases both edge portions of the heater holder 17 in an axial direction of the pressure roller 22 with a force of 147 N (15 kgf) on one side and with a total force of 294 N (30 kgf) on both sides. The downward surface of the fixing heater 16 is pressure-contacted with the elastic layer of the pressure roller 22 via the fixing sleeve 20 with a predetermined pressure against the elasticity thereof to form a fixing nip portion 27 having a predetermined width sufficient for heat fixing. The pressure mechanism has an automatic pressure change mechanism which can change the pressurization according to the media to be passed as described later.

The apparatus frame 24 includes an inlet guide 23 and a fixing paper discharge roller 26 placed therein. The inlet guide 23 serves to accurately guide the recording material P that has passed through the secondary transfer nip portion M so as to reach the fixing nip portion 27. The inlet guide 23 of the present embodiment is made of a polyphenylene sulfide (PPS) resin.

The pressure roller 22 is rotatably driven at a predetermined peripheral speed in the counterclockwise direction of the arrow by a drive unit (not illustrated). When the pressure roller 22 is rotatably driven, a frictional force caused by the pressure-contact occurs at the fixing nip portion 27 between the outer surface of the pressure roller 22 and the fixing sleeve 20. The frictional contact force generates a rotational force on the cylindrical fixing sleeve 20. Then, the fixing sleeve 20 is in a driven rotating state in the clockwise direction of the arrow along the outer circumference of the heater holder 17, while the fixing sleeve 20 is sliding with its inner side being in close contact with the downward surface of the fixing heater 16. Grease is applied to the inner surface of the fixing sleeve 20 so as to maintain slidability between the heater holder 17 and the inner surface of the fixing sleeve 20.

When the pressure roller 22 is rotatably driven, the cylindrical fixing sleeve 20 enters the driven rotating state accordingly. Further, when power is applied to the fixing heater 16, the temperature of the fixing heater 16 is adjusted to rise to a predetermined temperature. In this state, the recording material P carrying an unfixed toner image t is guided and introduced at the fixing nip portion 27 between the fixing sleeve 20 and the pressure roller 22 along the inlet guide 23. Then, the recording material P is pinched at and conveyed through the fixing nip portion 27 together with the fixing sleeve 20 while the toner carrying surface side of the recording material P is in close contact with the outer surface of the fixing sleeve 20. In this pinching and conveying process, the heat of the fixing heater 16 is transferred to the recording material P via the fixing sleeve 20, and the unfixed toner image on the recording material P is heated and pressurized on the recording material P to be melt-fixed. The recording material P having passed through the fixing nip portion 27 is separated from the fixing sleeve 20 by the difference of curvature by itself and is discharged from the fixing paper discharge roller 26.

Note that fixing sleeve 20 further includes a sleeve thermistor 18, an arm 25 supporting the sleeve thermistor 18, and a main thermistor 19 which will be described later with reference to FIG. 5. A control unit 21 controls the temperature of the fixing heater 16 based on the temperatures detected by the sleeve thermistor 18 and the main thermistor 19 so as to optimally heat the recording material P.

2) Fixing Heater 16

Figure 3:
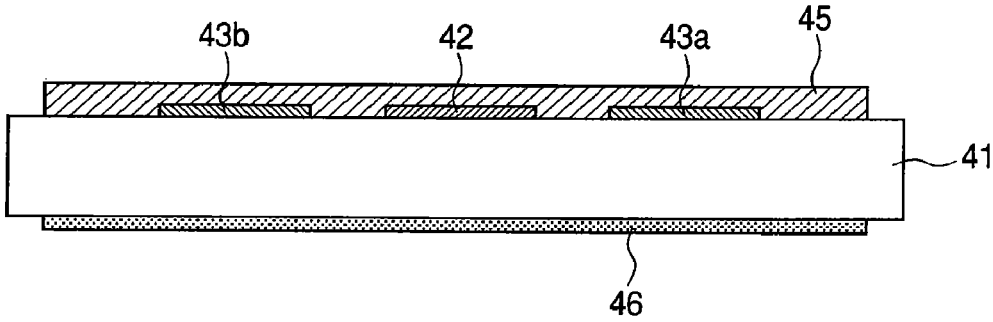
FIG. 3 is a sectional view of a fixing heater in accordance with the first and second embodiments.

FIG. 3 is a sectional view of the fixing heater 16.

The fixing heater 16 includes the following components (1) to (5).

(1) An alumina substrate 41 which is a horizontally long ceramic substrate with its longitudinal direction being perpendicular to the conveyance direction of the recording material P, namely, the sheet passing direction.

(2) Resistance-type heat generation layers 42 and 43 (43*a* and 43*b*) with a thickness of approximately 10 μm and a width of approximately 1 mm, covering the upper surface of the alumina substrate 41 described at (1) along the longitudinal direction in a form of a line or a strip by a screen print. The resistance-type heat generation layers 42 and 43 are formed by printing a conductive paste containing a silver/palladium (Ag/Pd) alloy on the alumina substrate 41.

Figure 4A:
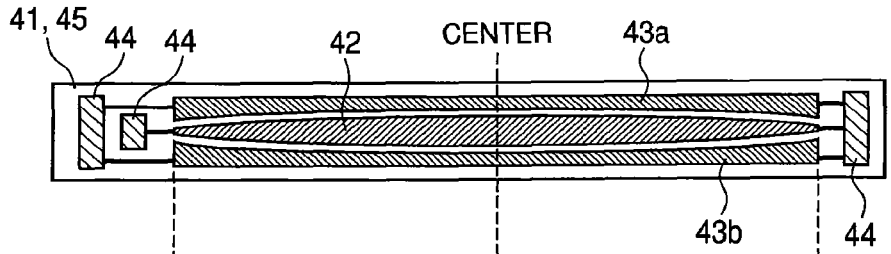
FIG. 4A is a surface side view of the fixing heater in accordance with the first and second embodiments.
Figure 4B:
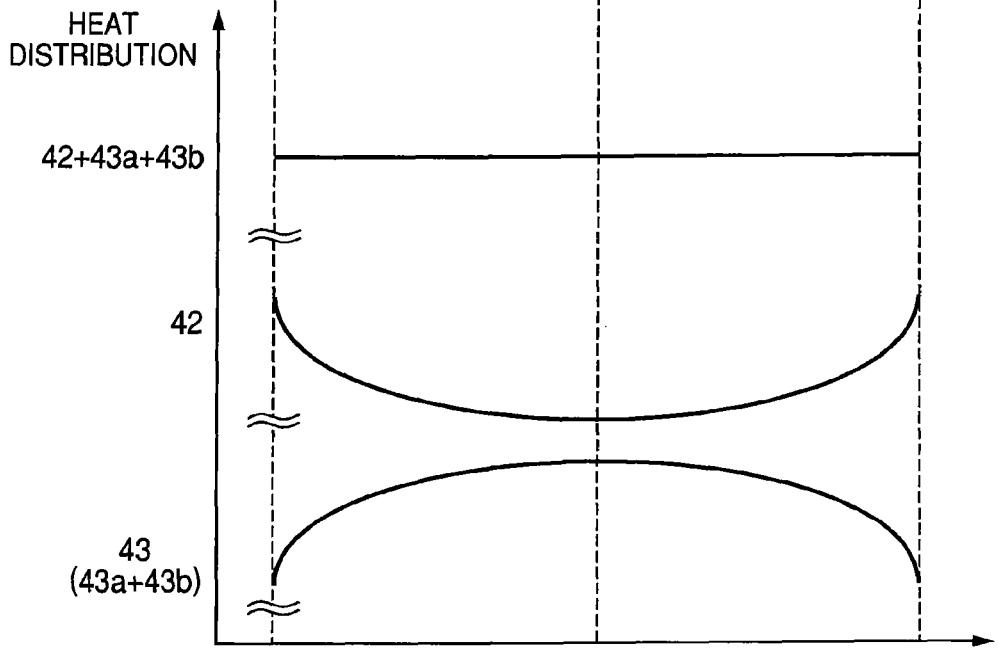
FIG. 4B is a graph illustrating a heat distribution of the fixing heater corresponding to FIG. 4A.

(3) An electrode portion 44 formed by screen printing a silver paste on the upper surface of the alumina substrate 41 as a pattern for feeding power to the resistance-type heat generation layers 42 and 43 described at (2) (see FIGS. 4A and 4B).

(4) A thin glasscoat 45 with a thickness of approximately 30 μm for maintaining the protection and insulation of the resistance-type heat generation layers 42 and 43.

(5) A sliding layer 46 made of polyimide and formed on a surface of the alumina substrate 41 with its surface in contact with the fixing sleeve 20.

FIG. 4A is a figure illustrating a surface side view of the fixing heater 16; and FIG. 4B is a graph illustrating a heat distribution of the fixing heater 16.

As illustrated in FIGS. 4A and 4B, the resistance-type heat generation layer includes three heat generation members 43 (43*a* and 43*b*) and 42. The heat generation member 43 corresponds to a first heat generation member. The heat generation member 42 corresponds to a second heat generation member whose resistance ratio per unit length between the lengthwise center portion and the edge portions is larger than that of the first heat generation member 43. The heat generation members 43 (43*a* and 43*b*) become consecutively wider from the lengthwise center region to the edge portions, and accordingly the amount of heat becomes gradually smaller from the lengthwise center region to the edge portions (see the heat distribution 43 (43*a* and 43*b*) in FIGS. 4A and 4B) (hereinafter the heat generation member 43 is referred to as the main heat generation member). In contrast, the heat generation member 42 becomes consecutively narrower from the lengthwise center region to the edge portions, and accordingly the amount of heat becomes gradually larger from the lengthwise center region to the edge portions (see the heat distribution 42 in FIGS. 4A and 4B) (hereinafter the heat generation member 42 is referred to as the sub-heat generation member). Therefore, the fixing member in accordance with the present embodiment can provide uniform heat distribution across the fixing nip portion, and thus can effectively suppress the rise in temperature of a sheet up to A3 size in the non-sheet pass-through portion (edge portions).

The electrode portion 44 of the fixing heater 16 connects to a feeding connector. When power is applied to the electrode portion 44 from a heater drive circuit portion via the feeding connector, the resistance-type heat generation layers 42 and 43 are heated and the temperature of the fixing heater 16 is quickly raised.

In a normal use, when the pressure roller 22 starts rotating, the fixing sleeve 20 starts rotating following the rotation of the pressure roller 22. As the temperature of the fixing heater 16 rises, the internal temperature of the fixing sleeve 20 rises accordingly. The PID control controls the power to be applied to the fixing heater 16. More specifically, the input power is controlled such that the internal temperature of the fixing sleeve 20, namely, the temperature detected by the sleeve thermistor 18 reaches a target value.

Figure 5:
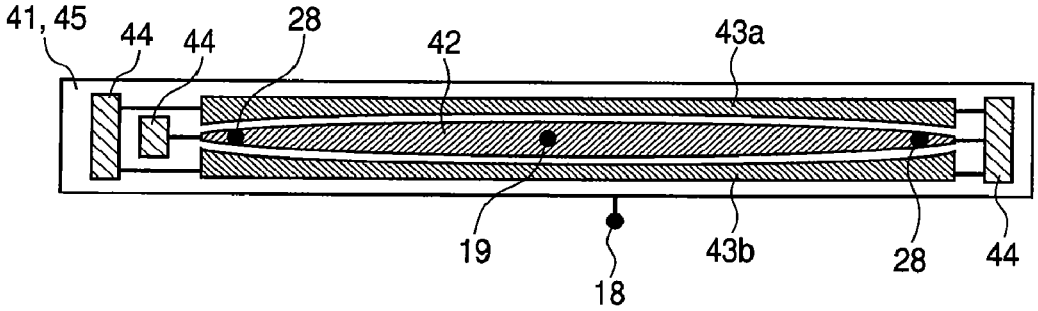
FIG. 5 is a positional view of the fixing heater and a thermistor in accordance with the first and second embodiments.

FIG. 5 illustrates the positional relationship of the fixing heater 16 and the thermistors. According to the present embodiment, in order to detect a rise in temperature of the non-sheet pass-through portion when a recording material with its width narrower than a maximum passing sheet width is passed, the fixing heater 16 is configured to include not only the sleeve thermistor 18 and the main thermistor 19, but also edge portion thermistors 28 at both edge portions. The sleeve thermistor 18 serving to detect the inner temperature of the fixing sleeve 20 has a thermistor element attached to the front edge of the stainless-steel arm 25 fixedly supported by the heater holder 17. The arm 25 elastically swings so that the thermistor element is always kept to be in contact with the inner surface of the fixing sleeve 20 even in an unstable state of the inner operation of the fixing sleeve 20 (FIG. 2). The main thermistor 19 is positioned to be in contact with the lengthwise center portion of the rear surface of the fixing heater 16 to detect the temperature of the rear surface of the fixing heater. The edge portion thermistors 28 are provided in the no-passing sheet portion with a width of 279 mm, namely, across-direction-feeding size of the letter (LTR) size so that the temperature of the no-passing sheet portion can be detected when a recording material with the LTR size is passed. The fixing member of the present embodiment controls the supplying of power to the heater 16 so that the temperature detected by the main thermistor 19 maintains a set temperature. When the temperature detected by the sleeve thermistor 18 is outside the target temperature, the set temperature to be compared with the temperature detected by the main thermistor 19 is corrected.

3) Fixing Sleeve 20

According to the present embodiment, the fixing sleeve 20 is a cylindrical member (endless belt shape) having an elastic layer on a belt-shaped member. More specifically, the fixing sleeve 20 is made of SUS (Steel Use Stainless) and has a silicon rubber layer (elastic layer) with a thickness of approximately 300 μm formed on a cylindrical endless belt (belt base member) with a thickness of 30 μm. Further, the silicon rubber layer is covered with a PFA resin tube (uppermost surface layer) with a thickness of 30 μm. When the heat capacity of the fixing sleeve 20 configured as above is measured, the heat capacity of the fixing sleeve per 1 $cm^2$ is $2.9\times10^{-2}$ cal/$cm^2$·° C.

(1) Base Layer of the Fixing Sleeve

Polyimide may be used as the base layer of the fixing sleeve 20, but SUS has approximately 10 times higher thermal conductivity than polyimide and higher on-demand property. In view of this, the present embodiment uses SUS to form the base layer of the fixing sleeve 20.

(2) Elastic Layer of the Fixing Sleeve

The elastic layer of the fixing sleeve 20 uses a rubber layer with a high thermal conductivity. This is to obtain a higher on-demand property. The specific heat of the material used for the present embodiment is approximately $2.9\times10^{-1}$ cal/g·° C.

(3) Mold Release Layer of the Fixing Sleeve

The fixing sleeve 20 has a fluorocarbon resin layer formed on the upper surface thereof, which can improve the surface mold release property and can prevent the offset phenomenon, which occurs when toner is once adhered to the surface of the fixing sleeve 20 and moves again onto the recording material P. Further, a PFA tube can be used to form a uniform fluorocarbon resin layer on the surface of the fixing sleeve 20 in a simpler and easier manner.

(4) Heat Capacity of the Fixing Sleeve

In general, the greater the heat capacity of the fixing sleeve 20, the less the temperature rising speed thereof, and the on-demand property is impaired. For example, depending on the configuration of the fixing member, an assumption is made that the heater is not heated at a standby state waiting for a print instruction. In this state, in order to activate the heater within one minute from when the print instruction is entered, the heat capacity of the fixing sleeve 20 needs to be equal to or less than approximately 1.0 cal/$cm^2$·° C.

The present embodiment assumes that power is turned on when a certain amount of time has elapsed since the power was turned off. For example, at the first morning activation, the temperature of the fixing sleeve 20 is designed to reach 190° C. within 20 seconds after 1000 W of power is applied to the fixing heater 16. The silicon rubber layer is made of a material whose specific heat is approximately $2.9\times10^{-1}$ cal/g·° C. In this case, the silicon rubber needs to be equal to or less than 500 μm thick, and the heat capacity of the fixing sleeve 20 needs to be equal to or less than approximately $4.5\times10^{-2}$ cal/$cm^2$·° C. However, to make the heat capacity of the fixing sleeve 20 equal to or less than $1.0\times10^{-2}$ cal/$cm^2$·° C., the rubber layer thereof needs to be extremely thin. Then, the resultant fixing sleeve 20 is equivalent to an on-demand fixing apparatus without having an elastic layer in terms of the image quality such as the transparency of the OHT (overhead transparency) and the uneven gloss.

According to the present embodiment, the thickness of the silicon rubber required to provide a high quality image in terms of the OHP transparency and gloss settings is equal to or greater than 200 μm and the heat capacity thereof is $2.1\times10^{-2}$ cal/$cm^2$·° C.

In summary, in the same configuration of the fixing apparatus as that the present embodiment, the heat capacity of the fixing sleeve 20 is generally targeted to be equal to or greater than $1.0\times10^{-2}$ cal/$cm^2$·° C. and equal to or less than 1.0 cal/$cm^2$·° C. In view of this, a fixing sleeve having a heat capacity from $2.1\times10^{-2}$ cal/cm$^{2}\cdot$° C. to $4.5\times10^{-2}$ cal/cm$^{2}\cdot$° C. which can satisfy both the on-demand property and the high image quality is used.

4) Pressure Mechanism

Figure 6:
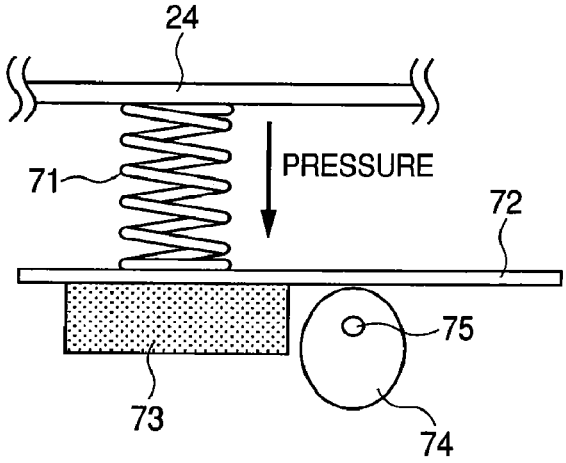
FIG. 6 is an explanatory drawing of a pressure mechanism under a first pressurization condition in accordance with the first and second embodiments.
Figure 7:
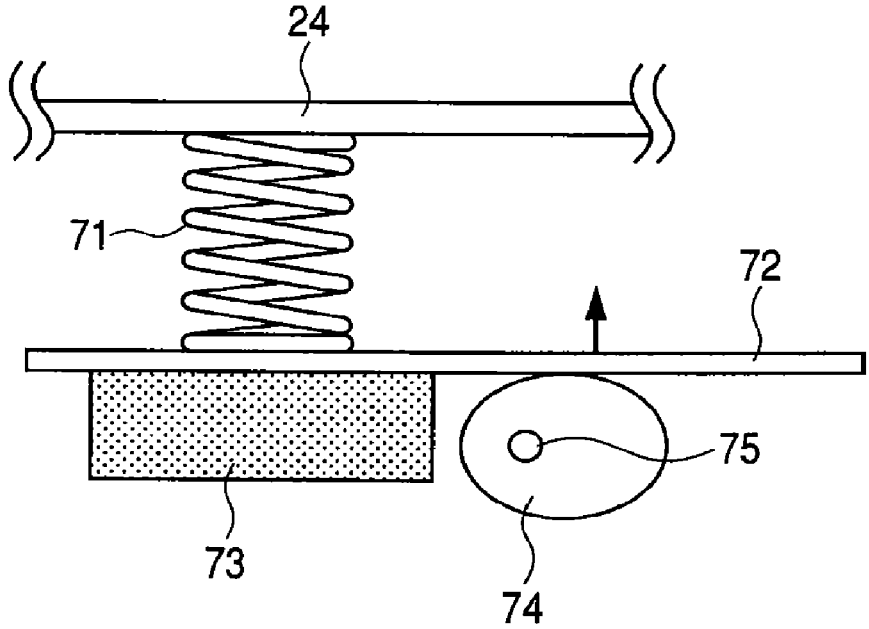
FIG. 7 is an explanatory drawing of a pressure mechanism under a second pressurization condition in accordance with the first and second embodiments.
Figure 8:
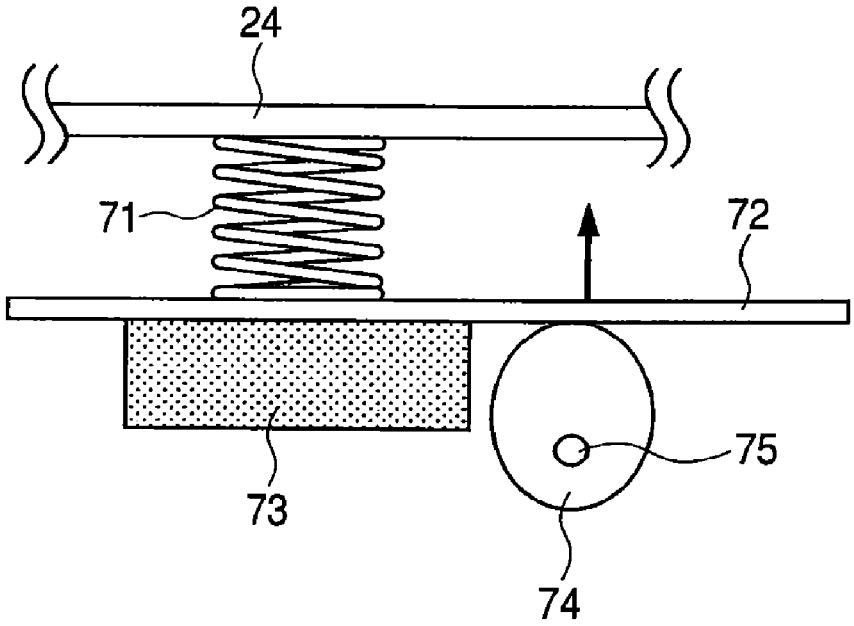
FIG. 8 is an explanatory drawing of a pressure mechanism under a third pressurization condition in accordance with the first and second embodiments.

FIGS. 6 to 8 are explanatory drawings of the pressure mechanism in accordance with the present embodiment. The pressure mechanism has a pressure spring 71 positioned between the apparatus frame 24 and a pressure plate 72. The pressure spring 71 presses a flange 73 toward the pressure roller 22 side. The flange 73 supports the heater holder 17 from both lengthwise sides. Further, the pressure mechanism includes cam members 74 as a part thereof. The cam members 74 face the pressure spring 71 via the pressure plates 72 at front and back sides sandwiched therebetween. The cam members 74 at front and back sides are of the same size and shape and are fixed to a cam shaft 75 in the same phase. The cam shaft 75 is rotatably borne and held, and is rotated or stopped by a motor (not illustrated). FIG. 6 illustrates the state in which the cam member 74 is not in contact with the pressure plate 72, and a maximum pressure is applied to the fixing nip portion (first pressurization condition). In other words, FIG. 6 illustrates the state in which the first pressurization is applied to the fixing nip portion. When the cam shaft 75 is rotated at 90° from the state illustrated in FIG. 6, the cam member 74 is changed to the state illustrated in FIG. 7, where the pressure plate 72 is pressed up and thus the pressure can be set to a pressure lower than the first pressurization condition (second pressurization condition). In other words, FIG. 7 illustrates the state in which the second pressurization is applied to the fixing nip portion. Further, when the cam shaft 75 is rotated by 90° from the state illustrated in FIG. 7, the cam member 74 is changed to the state illustrated in FIG. 8, where the pressure plate 72 is further pressed up and thus the pressure can be set to further lower than the second pressurization condition (third pressurization condition).

The fixing apparatus of the present embodiment has the following two fixing process modes.

I. The first fixing process mode of performing a fixing process under the first pressure (first pressurization condition)

II. The second fixing process mode of performing a fixing process under the second pressure (second pressurization condition)

According to the present embodiment, in normal print, the fixing process is performed under the first pressurization condition.

In order to prevent the envelope from being deflected, the fixing process is performed under the second pressurization condition.

In order to perform a jam process or turn off the main body (OFF), the third pressurization condition is set. The third pressurization condition may be set in a state where the endless belt is separated from the pressure roller, namely, in a state where no pressure is applied to the fixing nip portion.

5) Power Control During Sheet Passage

Hereinafter, power control for the fixing heater 16 during sheet passage under the respective pressurization condition will be described.

FIG. 9A illustrates a schematic nip shape of the fixing nip portion 27 formed between the pressure roller 22 and the fixing sleeve 20 under the first pressurization condition; and FIG. 9B illustrates a schematic nip shape of the fixing nip portion 27 formed between the pressure roller 22 and the fixing sleeve 20 under the second pressurization condition. In order to obtain a uniform nip shape in the longitudinal direction in a state where the pressure roller 22 is deflected under the first pressurization condition, the heater holder 17 is formed into a crown shape of approximately 900 μm (the center portion is larger than the edge portions). For this reason, under the first pressurization condition, there is no major difference between the amount of deflection of the pressure roller 22 and the amount of crown of the heater holder 17, resulting in a nip shape with a substantially uniform width in the longitudinal direction (FIG. 9A). In contrast, under the second pressurization condition, the amount of deflection of the pressure roller 22 is small due to small pressurization but the amount of crown of the heater holder 17 remains the same that under the first pressurization condition. As a result, there is a difference of pressurization in the longitudinal direction resulting in a nip shape of the edge portions with a narrow width (FIG. 9B).

FIG. 10 shows the fixing nip widths under the first pressurization condition and the second pressurization condition.

Under the first pressurization condition, the center portion and the edge portion have substantially the same fixing nip width. Note that edge portion corresponds to the position of the edge portion thermistor 28, approximately 144 mm far from the center. In contrast to this, under the second pressurization condition, the fixing nip width of the center is approximately 8.0 mm, while the fixing nip width of the edge portion is as narrow as approximately 6.0 mm. In other words, in terms of pressure applied to the fixing nip portion, the ratio (edge width/center width) of the fixing nip width under second pressurization condition is smaller than that under first pressurization condition.

According to the present embodiment, when a recording material of an A3 size sheet (297 mm wide) is passed (fixing process is performed thereon) under the first pressurization condition (normal pressure), the applied current proportion of the heater is set as main (43):sub (42)=100:100. FIG. 11 illustrates the heat distribution in this case. FIG. 12 shows the pressurization conditions, the applied current proportions of the heater, and the rising temperatures of the heater at the respective position where the thermistor is provided in the center portion and the edge portion during sheet passes. The heat distribution is of an A3 size sheet width and of an approximately flat shape. There is no rise in temperature of the edge portion thermistor 28 during sheet passage in accordance with the present embodiment (illustrated by the solid line in FIG. 11). More specifically, as shown in FIG. 12, the rising temperature of the heater at the position where the center thermistor 19 is provided under first pressurization condition is approximately 250° C. and the rising temperature of the heater at the position where the edge portion thermistor 28 is provided under first pressurization condition is approximately 245° C.

When the pressurization condition of the fixing apparatus 12 is set to the second pressurization condition and an envelope with a COM#10 size (approximately 105 mm wide× approximately 241 mm long) is passed as an example, the rising temperatures of the heater at the respective portions are shown in FIG. 12. When the heat distribution of the heater in the comparison example is the same as in the first pressurization condition (the applied current proportion of the heater as 100:100), the fixing nip width of the edge portions is small and thus heat of the fixing heater 16 is difficult to be transferred to the pressure roller 22 side. Therefore, in the comparison example under the second pressurization condition, the temperature of the edge portion thermistor 28 is higher than the temperature of the main thermistor 19. More specifically, heater power is controlled so that the main thermistor 19 reaches the target temperature (250° C.) and thus the heater temperature at the center portion is 250° C., while the temperature of the edge portion thermistor exceeds the withstanding temperature limit 270° C. of the heater holder 17.

If a high temperature state where the temperature of the edge portion thermistor exceeds 270° C. continues, not only the heater holder 17 but also the fixing sleeve 20 and the thermistor itself, quickly deteriorate.

According to the present embodiment, the applied current proportion of the heater under second pressurization condition is changed to main:sub=100:0 from that of the first pressurization condition. In other words, when the fixing process is performed under the second fixing process mode, the heat proportion of the second heat generation member 42 (sub) is set to be smaller than that of first heat generation member 43 (main). When the fixing process is performed under the second fixing process mode, the magnitude relationship between the heat proportion of the second heat generation member 42 and the heat proportion of the first heat generation member 43 is the same regardless of the size of the recording material (envelope).

In this case, the lengthwise heat distribution is larger in the center portion than in the edge portions (illustrated by the broken line in FIG. 11). Therefore, under the second pressurization condition, the temperature of the edge portion thermistor 28 is lower than that of the main thermistor 19. More specifically, as shown in FIG. 12, when the applied current proportion is set as main:sub=100:0 under the second pressurization condition, the rising temperature of the heater at the position where the center thermistor is provided is approximately 250° C., and the rising temperature of the heater at the position where the edge portion thermistor is provided is approximately 200° C. The rising temperature of the heater at the position where the edge portion thermistor is provided is approximately 200° C., which can prevent quick deterioration of the heater holder 17, the fixing sleeve 20, and the thermistor itself.

Figures 13, 14:
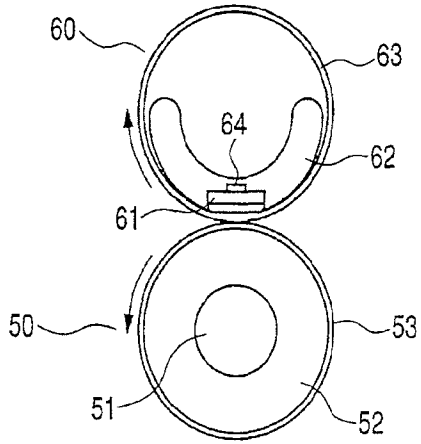
PRIOR ART FIG. 13
FIG. 13 is an explanatory drawing of the heat fixing apparatus using a film heating process.
FIG. 14 is a drawing showing the applied current proportion in a case where a fixing process is performed under the first fixing process mode (first pressurization condition) and in a case where a fixing process is performed under the second fixing process mode (second pressurization condition).

In contrast, when the fixing process is performed in the first fixing process mode, the applied current proportion of the second heat generation member 42 (sub) may be larger than or may be the same as the first heat generation member 43 (main) depending on the size of the recording material. FIG. 14 shows all the applied current proportions in accordance with the present embodiment in a case where the fixing process is performed under the first fixing process mode (first pressurization condition) and in a case where the fixing process is performed under the second fixing process mode (second pressurization condition). As shown in FIG. 14, when the fixing process is performed in the second fixing process mode, the heat proportion of the second heat generation member 42 (sub) is set to be smaller than that the first heat generation member 43 (main) regardless of the size of the recording material (envelope).

In this manner, the applied current proportion between the main heater and the sub-heater is changed according to the pressurization condition, which can prevent the fixing member and the like from been deteriorated due to an excessive temperature rise.

Regarding the applied current proportion of the heater under the second pressurization condition, the applied current proportion may be appropriately set as long as the heat proportion of the second heat generation member 42 (sub) is set to be smaller than the heat proportion of the first heat generation member 43 (main) without a need to use the proportion of main:sub=100:0.

Note that the second fixing process mode of the present embodiment is a mode for reducing the deflection of an envelope. When the fixing process is performed on a large sized envelope under the second fixing process mode, the fixability of the toner image corresponding to an area with a high resistance of the second heat generation member (sub) (area with a large amount of heat generation) is reduced. Since the second fixing process mode places a higher priority on reducing deflection of an envelope, in order to place a higher priority on fixability of the toner image, the first fixing process mode may be used to perform the fixing process on the envelope carrying the toner image.

Second Embodiment

Hereinafter, the second embodiment of the present invention will be described. The first embodiment relates to the applied current proportion of the heat generation member during fixing process; while the second embodiment relates to the applied current proportion in the case of activating the fixing apparatus to a fixable state. Since the structure and the like of the heater are the same as those in the first embodiment, the description thereof is omitted.

Figure 15:
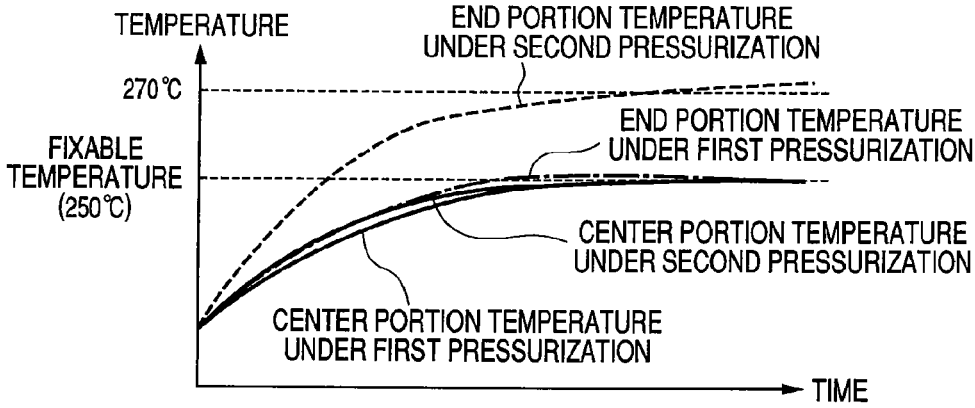
FIG. 15 is an explanatory drawing describing the thermistor temperature transition with the applied current proportion 10:10 in accordance with the second embodiment.

FIG. 15 illustrates the temperature transition of the main thermistor 19 and the edge portion thermistor 28 when heated with the applied current proportion between the main heat generation member 43 and the sub-heat generation member 42 as main:sub=10:10. There is no major difference in temperature between the main thermistor 19 and the edge portion thermistor 28 because the fixing nip shape is uniform under the first pressurization condition. In contrast, under the second pressurization condition, heat of the fixing heater 16 is difficult to be transferred to the pressure roller 22 side because the fixing nip width is small in edge portions. Therefore, under the second pressurization condition, the temperature of the edge portion thermistor 28 rises earlier than that of the main thermistor 19, and the temperature of the edge portion thermistor exceeds the withstanding temperature limit 270° C. of the heater holder 17 before the main thermistor 19 reaches the target temperature (fixable temperature) (250° C.). If a high temperature state where the temperature of the edge portion thermistor exceeds 270° C. continues, not only the heater holder 17 but also the fixing sleeve 20 and the thermistor itself, quickly deteriorate.

Figure 16:
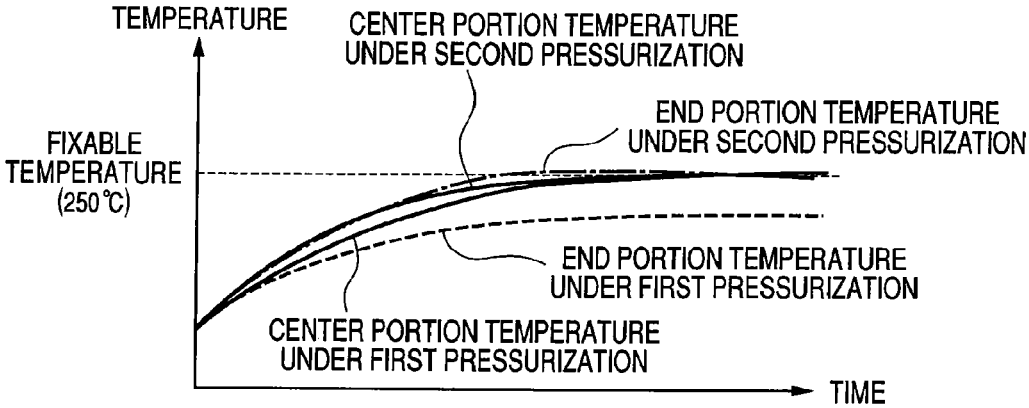
FIG. 16 is an explanatory drawing describing the thermistor temperature transition with the applied current proportion 10:3 in accordance with the second embodiment.

FIG. 16 illustrates the thermistor temperature transition of the main thermistor 19 and the edge portion thermistor 28 when heated with the applied current proportion between the heat generation members as main:sub=10:3. In this case, the lengthwise heat distribution is larger in the center portion than in the edge portions. Therefore, under the first pressurization condition, the temperature of the edge portion thermistor 28 is lower than that of the main thermistor 19. In this case, at the initial print stage, there is a difference in fixability between the center portion and the edge portions and thus a fixing failure may occur in the edge portions. Further, it takes long for the main thermistor 19 to reach the target temperature because the entire applied current is smaller than in the case of main:sub=10:10. In contrast, as described above, under the second pressurization condition, heat of the edge portions is difficult to be transferred to the pressure roller 22 because the fixing nip width is smaller in edge portions than in the center portion. Therefore, although the amount of heat generation is small in the edge portions, there is no major difference in temperature between the main thermistor 19 and the edge portion thermistor 28. Further, it takes shorter for the main thermistor 19 to reach the target temperature than under the first pressurization condition because the fixing nip width in the center portion is smaller than under the first pressurization condition.

The above described findings are summarized in Table 1.

TABLE 1

| | Applied current proportion (main:sub) | |
|---|---|---|
| | 10:10 | 10:3 |
| First pressurization condition | Good | Fixing failure in edge portions slow in activation |
| Second pressurization condition | High temperature in edge portions | Good |

Therefore, according to the present embodiment, the applied current proportion between the main heater and the sub-heater until the heat fixing apparatus reaches the sheet passable state is set to 10:10 for the first pressurization condition and 10:3 for the second pressurization condition.

In this manner, by changing the applied current proportion between the main heater and the sub-heater according to the pressurization condition, and more specifically, in a state where the pressure applied to the fixing nip portion is set to the second pressure, the temperature of the heater is raised to the fixable temperature, by setting the heat proportion of the second heat generation member to be lower than the heat proportion of the first heat generation member, so that abnormal temperature rise in edge portions and a fixing failure in edge portions can be prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Laid-Open No. 2008-142835, filed May 30, 2008, No. 2008-320916, filed Dec. 17, 2008, and No. 2009-117593, filed May 14, 2009, which are hereby incorporated by reference herein in their entirety.

What is claimed is:

1. A heat fixing apparatus for heating and fixing a toner image formed on a recording material onto the recording material, comprising:

an endless belt;

a heater that contacts an internal surface of the endless belt, the heater having a first heat generation member, and a second heat generation member whose ratio of a resistance value per unit length at edge portions to the resistance value per unit length at a center portion in a longitudinal direction of the heater is larger than that of the first heat generation member;

a back-up member configured to form a fixing nip portion that pinches and conveys a recording material through the endless belt together with the heater; and a pressure change mechanism configured to set a pressure applied to the fixing nip portion to a first pressure and a second pressure lower than the first pressure, wherein the apparatus operates in a first fixing process mode for performing a first fixing process under the first pressure and a second fixing process mode for performing a second fixing process under the second pressure, and wherein a heat proportion of the second heat generation member in the second fixing process mode is zero, or is smaller than a heat proportion of the second heat generation member in the first fixing process mode;

wherein power is supplied to the heater while the second pressure is applied to the fixing nip portion.

2. The heat fixing apparatus according to claim 1, wherein a width ratio between a center portion and an edge portion in the fixing nip portion when a pressure applied to the fixing nip portion is set to the second pressure is smaller than a width ratio between the center portion and the edge portion in the fixing nip portion when the pressure applied to the fixing nip portion is set to the first pressure.

3. The heat fixing apparatus according to claim 2, wherein the pressure change mechanism is also configured to set the pressure applied to the fixing nip portion to a third pressure lower than the second pressure, or to zero.

4. The heat fixing apparatus according to claim 3, wherein the pressure change mechanism is configured to set the third pressure at a time either when the recording material jammed in an image forming apparatus having the heat fixing apparatus is removed or when the image forming apparatus is turned off.

5. The heat fixing apparatus according to claim 2, wherein the second fixing process mode is defined as a mode in which an envelope is used for the recording material.

6. The heat fixing apparatus according to claim 2, wherein in the first fixing process mode, the heat proportion of the first heat generation member and the heat proportion of the second heat generation member are set according to the size of the recording material.

7. The heat fixing apparatus according to claim 6, wherein in the second fixing process mode, the heat proportion of the first heat generation member and the heat proportion of the second heat generation member are fixed.

8. A heat fixing apparatus for heating and fixing a toner image formed on a recording material onto the recording material, comprising:

an endless belt;

a heater that contacts an internal surface of the endless belt, the heater having a first heat generation member, and a second heat generation member whose ratio of a resistance value per unit length at edge portions to the resistance value per unit length at a center portion in a longitudinal direction of the heater is larger than that of the first heat generation member;

a back-up member configured to form a fixing nip portion that pinches and conveys a recording material through the endless belt together with the heater; and a pressure change mechanism configured to set a pressure applied to the fixing nip portion to a first pressure and a second pressure lower than the first pressure, wherein a heat proportion of the second heat generation member when the temperature of the heater is raised to a fixable temperature with the pressure applied to the fixing nip portion set to the second pressure is zero, or is smaller than a heat proportion of the second heat generation member when the temperature of the heater is raised to a fixable temperature with the pressure applied to the fixing nip portion set to the first pressure;

wherein power is supplied to the heater while the second pressure is applied to the fixing nip portion.

9. The heat fixing apparatus according to claim 8, wherein a width ratio between a center portion and an edge portion in the fixing nip portion when a pressure applied to the fixing nip portion is set to the second pressure is smaller than a width ratio between the center portion and the edge portion in the fixing nip portion when the pressure applied to the fixing nip portion is set to the first pressure.

10. The heat fixing apparatus according to claim 9, wherein the pressure change mechanism is also configured to set the pressure applied to the fixing nip portion to a third pressure lower than the second pressure, or to zero.

11. The heat fixing apparatus according to claim 10, wherein the pressure change mechanism sets the third pressure at a time either when the recording material jammed in an image forming apparatus having the heat fixing apparatus is removed or when the image forming apparatus is turned off.

12. A heat fixing apparatus for heating and fixing a toner image formed on a recording material onto the recording material, comprising:

an endless belt;

a heater configured to heat the endless belt, the heater having a first heat generation member, and a second heat generation member whose ratio of a heat generating amount per unit length at edge portions to the heat generating amount per unit length at a center portion in a longitudinal direction of the heater is larger than that of the first heat generation member;

a back-up member configured to contact the endless belt to form a fixing nip portion; and a pressure change mechanism configured to change a pressure applied to the fixing nip portion to a first pressure and a second pressure lower than the first pressure, wherein a heat generating amount of the second heat generation member, when power is supplied to the heater under the second pressure applied to the fixing nip portion, is zero, or a heat generating amount of the second heat generation member, when power is supplied to the heater under the second pressure applied to the fixing nip portion, is smaller than a heat generating amount of the second heat generation member when power is supplied to the heater under the first pressure applied to the fixing nip portion.

13. The heat fixing apparatus according to claim 12, wherein a width ratio between a center portion and an edge portion in the fixing nip portion when a pressure applied to the fixing nip portion is set to the second pressure is smaller than a width ratio between the center portion and the edge portion in the fixing nip portion when the pressure applied to the fixing nip portion is set to the first pressure.

14. The heat fixing apparatus according to claim 13, wherein the pressure change mechanism is configured to set the pressure applied to the fixing nip portion to a third pressure lower than the second pressure, or to zero.

15. The heat fixing apparatus according to claim 14, wherein the pressure change mechanism sets the third pressure at a time either when the recording material jammed in an image forming apparatus having the heat fixing apparatus is removed or when the image forming apparatus is turned off.

16. The heat fixing apparatus according to claim 13, wherein the second pressure is a pressure in a case where an envelope is used as the recording material.

* * * * *